United States Patent [19]

Klein et al.

[11] Patent Number: 4,627,364

[45] Date of Patent: Dec. 9, 1986

[54] VERTICALLY-ADJUSTABLE DESK STRUCTURE

[75] Inventors: Thomas A. Klein, Plainwell; Peter M. Baker, Mattawan, both of Mich.

[73] Assignee: Lear Siegler, Inc., Kalamazoo, Mich.

[21] Appl. No.: 811,691

[22] Filed: Dec. 20, 1985

[51] Int. Cl.[4] ..... A47B 9/00

[52] U.S. Cl. ..... 108/147; 248/422; 312/223; 312/312

[58] Field of Search ..... 297/147, 144, 20; 248/422, 188.4; 312/223, 312

[56] References Cited

U.S. PATENT DOCUMENTS

| | | | |
|---|---|---|---|
| 911,843 | 2/1909 | Sample | 108/147 X |
| 2,531,925 | 11/1950 | Taylor et al. | 312/312 X |
| 3,210,846 | 10/1965 | Balkin | 108/147 X |
| 3,259,081 | 7/1966 | Stalnacke | 108/147 |
| 3,938,820 | 2/1976 | Nabinger | 108/147 X |
| 4,323,291 | 4/1982 | Ball | 312/223 X |
| 4,372,629 | 2/1983 | Propst | 312/223 |
| 4,440,096 | 4/1984 | Rice | 108/20 X |
| 4,515,087 | 5/1985 | Kurrasch | 108/147 |
| 4,516,509 | 5/1985 | Langenegger et al. | 248/422 X |
| 4,535,703 | 8/1985 | Henriott et al. | 313/223 X |

FOREIGN PATENT DOCUMENTS

| | | | |
|---|---|---|---|
| 2133683 | 8/1984 | United Kingdom | 108/147 |

*Primary Examiner*—Peter A. Aschenbrenner
*Attorney, Agent, or Firm*—Gordon W. Hueschen;

[57] ABSTRACT

There is disclosed a desk having an adjustable top which is adjusted by means of telescoping legs. The legs are extended or contracted by means of a gearbox assembly mounted between two guided members of the telescoping legs which assembly in turn is affixed to the desk top by means of a channel member extending toward the front and parallel to the base members of the desk. The desk also has a channel provided for electrical wiring which may be opened and snapped closed, as desired.

13 Claims, 9 Drawing Figures

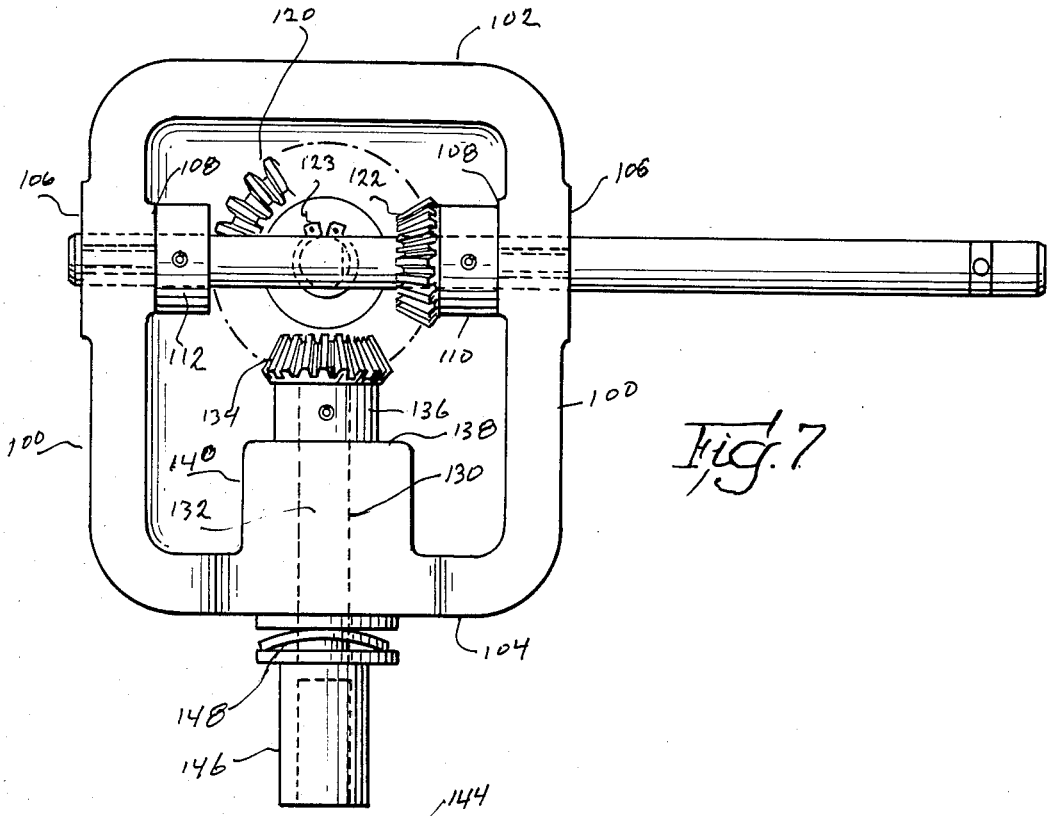
Fig. 7
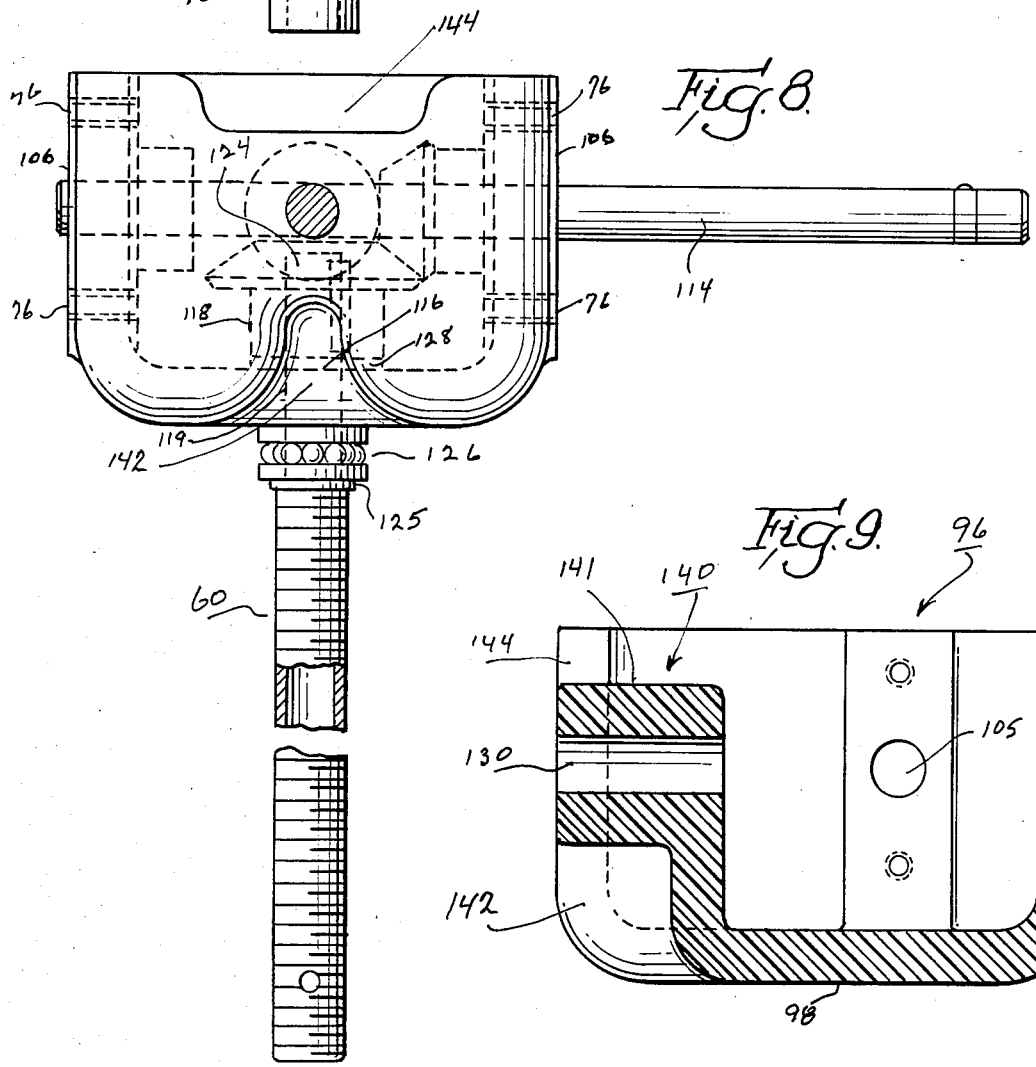
Fig. 8
Fig. 9

VERTICALLY-ADJUSTABLE DESK STRUCTURE

BACKGROUND OF THE INVENTION

1. Field of Invention

The invention relates vertically-adjustable desk structure and is particularly directed to improvements which make the desk more easy to construct, more easy to maintain, and more easy to repair.

2. Prior Art

Desks having a flat top supported by a leg member having a fixed base portion and an adjustable top portion and means for adjusting said leg member to raise and lower said flat top, comprising a driveshaft, a driven shaft, means for turning said driveshaft, an elevator screw threaded into a female screw affixed to said base portion of said leg member, and means for connecting said elevator screw to said driven shaft, whereby rotation of said drive shaft one way raises said top and rotation thereof in the other direction lowers it, are known in the art. Such desks as have been heretofore available, however, have been expensive to construct and difficult to repair and maintain.

SUMMARY OF THE INVENTION

The invention relates to improvements in a vertically-adjustable desk having a flat top supported by a leg member having a fixed base portion and an adjustable top portion and means for adjusting said leg member to raise and lower said flat top comprising a driveshaft, a driven shaft, means for turning said driveshaft, an elevator screw threaded into a female screw affixed to said base portion of said leg member, and means for connecting said elevator screw to said driven shaft, whereby rotation of said drive shaft one way raises said top and rotation thereof in the other direction lowers it; the improvement in which the means for affixing said female screw member to the fixed portion of said leg member comprises a flat supporting plate unitarily comprising said female threaded member with the axis thereof normal thereto and horizontally-disposed, plate-supporting means affixed to the fixed base portion of said leg member, said supporting means having a transverse opening therein through which said flat supporting plate can be slid horizontally into said plate-supporting means.

The invention also relates to one or more further improvement in which said plate-supporting means comprises a horizontally-disposed shelf member affixed to vertically-parallel post members of the fixed portion of said leg member and on which shelf member said supporting plate is supported and which comprises detents on said post members for removably holding said supporting plate on said shelf member; in which said plate-supporting means comprises a channel member, the sides of which are rigidly affixed to said post members; in which a portion of the web of said channel member is bent down to a position normal to the web and sides of said channel member to form said shelf member for supporting said flat supporting plate; in which portions of the sides of said channel member above said shelf member are bent in to a provide said detents, which portions are relatively short and parallel to said shelf member; in which the adjustable top portion of said leg member comprises vertically-parallel guided members depending from the desk top and the means for adjusting said leg member comprises a box-shaped housing of hard castable plastic having front, rear, and bottom walls and opposed side walls, which side walls are rigidly affixed to the inner sides of said vertically-parallel guided members; and said drive and driven shafts are journaled, respectively, in the side walls and bottom wall of said box-shaped housing; in which a second driven shaft is journaled in the rear wall of said housing, which wall is thick enough to provide a journal for said second driven shaft, which journal is at least two times as long as as the diameter of said second driven shaft, and in which said guided members are anchored in a transverse channel member affixed to the underside of said flat top and said box-shaped housing and said transverse channel cooperate to maintain the top portion of said leg member and the unitary structure in which said guided members are maintained in the stated vertically-parallel position.

The invention in another aspect thereof relates to improvements in a vertically-adjustable desk having a flat top supported by a leg member having a fixed base portion comprising vertically-parallel, hollow post members and an adjustable top portion comprising vertically-parallel guided members vertically guided in said hollow post members and means for adjusting said leg member to raise and lower said flat top, comprising a drive shaft, a driven shaft, means for turning said drive shaft, an elevator screw threaded into a female screw affixed to said base portion of said leg member, and means for connecting said elevator screw to said driven shaft, whereby rotation of said driveshaft one way raises said top and rotation thereof in the other direction lowers it; the improvement in which the means for adjusting said leg member comprises a box-shaped gear housing of hard, castable plasting having front, rear, and bottom walls and opposed side walls, which side walls are rigidly affixed to the inner sides of said vertically-parallel guided members with the bottom wall normal thereto and in which said drive and driven shafts are journaled, respectively, in the side walls and bottom wall of said box-shaped housing.

This aspect of the invention also comprises one or more further features in which a second driven shaft is journaled in the rear wall of said housing, which wall is thick enough to provide a journal for said second driven shaft, which journal is at least two times as long as as the diameter of said second driven shaft; and in which said plate-supporting means comprises a horizontally-disposed shelf member affixed to said vertically-parallel post members of the fixed portion of said leg member and on which shelf member said supporting plate is supported and which comprises detents on said post members for removably holding said supporting plate on said shelf member; in which said plate-supporting means comprises a channel member, the sides of which are rigidly affixed to said post members; in which a portion of the web of said channel member is bent down to a position normal to the web and sides of said channel member to form said shelf member for supporting said flat supporting plate; and in which portions of the sides of said channel member above said shelf member are bent in to a provide said detents, which bent-in portions are relatively short and parallel to said shelf.

The invention also relates to a vertically-adjustable desk structure having adustable leg members with telescoping side cover members comprising upper members affixed to the rear side edges of the top of said desk, said upper members extending beyond the rear edge of the top of said desk thereby providing a transverse channel along the rear edge thereof, and a hinged cover member spanning said channel having a flexible member on the forward edge thereof adapted to seat on the rear edge of said desk top and being spring-biased to closed position.

BRIEF DESCRIPTION OF THE DRAWINGS

FIG. 7 is a plan view of a gearbox assembly of the invention;

FIG. 8 is a side elevation of FIG. 7; and

FIG. 9 is a cross section of the gearbox of FIGS. 7 and 8.

DESCRIPTION OF THE PREFERRED EMBODIMENT

Figure 1:
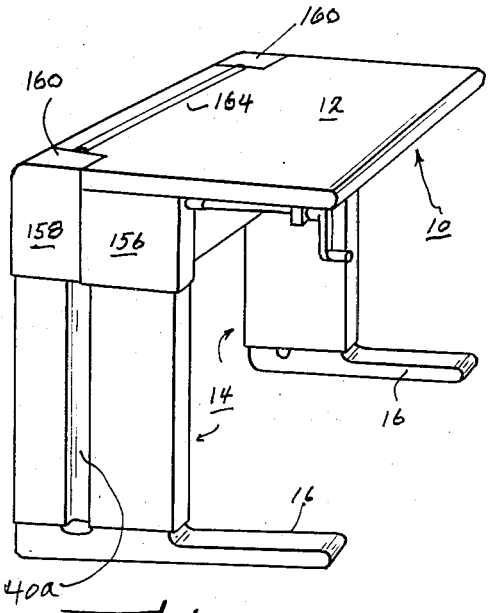
FIG. 1 is a perspective view of a desk according to the invention.
Figure 2:
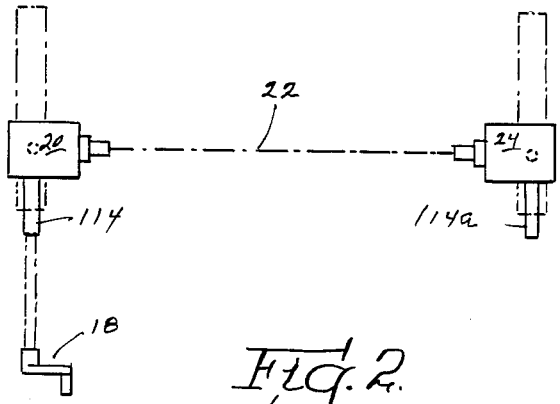
FIG. 2 is a detail view.
Figure 6:
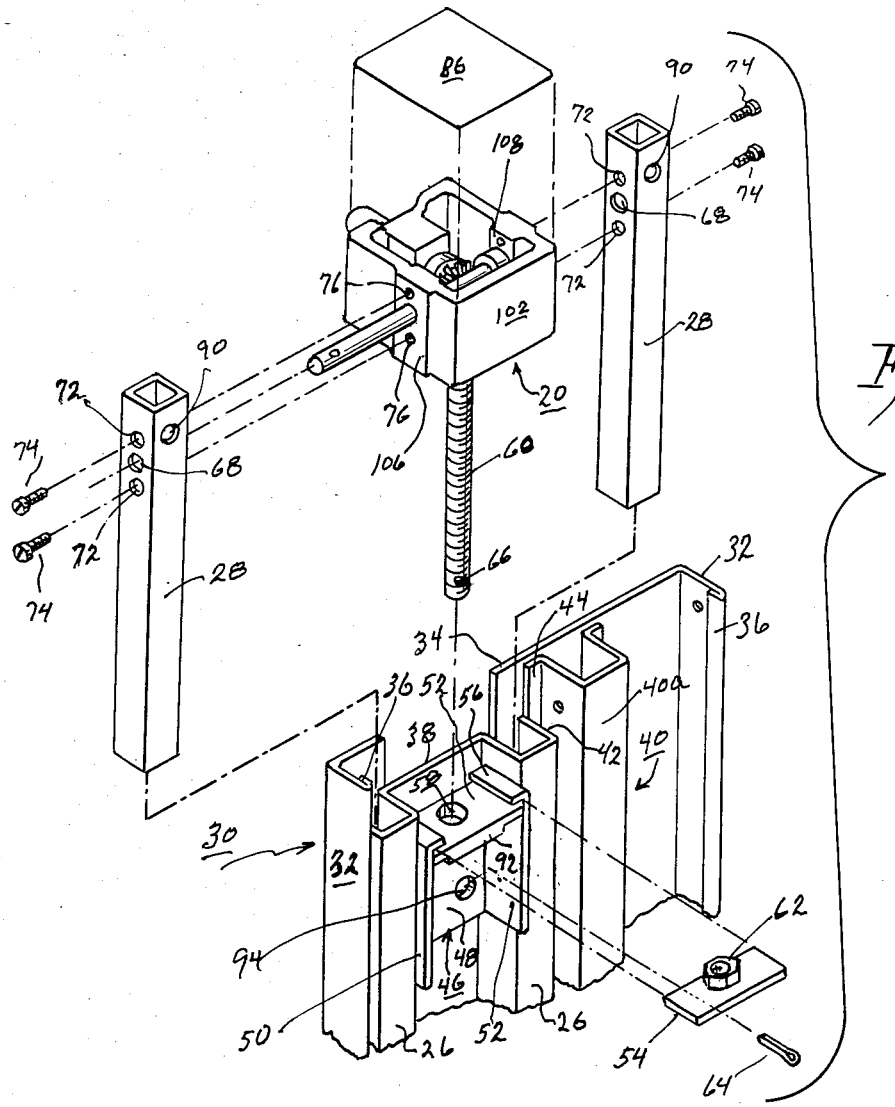
FIG. 6 is an exploded detail.

In FIG. 1 there is illustrated a vertically-adjustable desk 10 according to the invention. It has a flat top 12 and vertically-adjustable legs 14 having base members 16. The position of the top 12 is adjusted by means of a crank 18 operative to adjust the adjustable legs 14.

The crank 18 operates through a gearbox 20 for one of the legs and is connected by shaft 22 to gearbox 24 which operates to adjust the other leg simultaneously with the first one.

The adjustable legs 14 comprise vertical posts 26 which extend rigidly from the base members 16 in a vertically parallel position. Adapted to telescope into posts 26 are guided members 28 which are rigidly affixed to the table top in a vertically-parallel arrangement complementary with that of posts 26. Thus, by means of the crank 18 and the gear boxes 20 and 24, the position of the guided members 28 in the post 26 can be adjusted as desired in order to adjust the level of the table top 12.

The bottom portion 16 of each leg 14 comprises a channel member 30 having outstanding sides 32 and a web 34. The sides are turned in, as shown at 36, for strength and to enhance the appearance. The posts 26 are formed from a single sheet comprising a web 38 which is welded to the web 34 of the channel member 30. If desired, there may be provided an additonal hollow post 40 for the purpose of supporting a shelf over the desk. In such case, it is desirable to have the side 42 of the post 26 extend under the flanges 44 of the post 40. The whole assembly is welded or riveted together to form a unitary leg member.

Disposed between the hollow posts 26 is a channel member 46 having a web 48 and outstanding sides 50. The web 48 is welded or otherwise fastened to the web 38 and has its top portion 52 bent down to a position normal to a web 48 and the sides 50 to form a shelf for the plate or bar 54. The shelf 52 can be welded or otherwise affixed to the sides 50. The top ends 56 of the sides 50 are bent in parallel to the shelf 52 and are spaced therefrom to provide detents which form with the shelf 52 a channel for the bar or plate 54 to be slid in and out. The shelf 52 has a bore 58 to receive the elevator screw 60 of the gear box assembly 20. Fastened to the bar 54 is a threaded member 62 which, advantageously, is a hex nut welded over an opening (now shown) in the bar 54, corresponding to opening 58. Thus, the bar 54 can be slid in on top of the shelf 52 and under the detents 56 and the elevator screw 60 brought down to the nut 62 and threaded therethrough to provide the operative assembly. If desired, a cotter pin 64 can be inserted in a hole 66 in the elevator screw 60 so so that it cannot be inadvertently removed from the nut 62.

Figure 5:
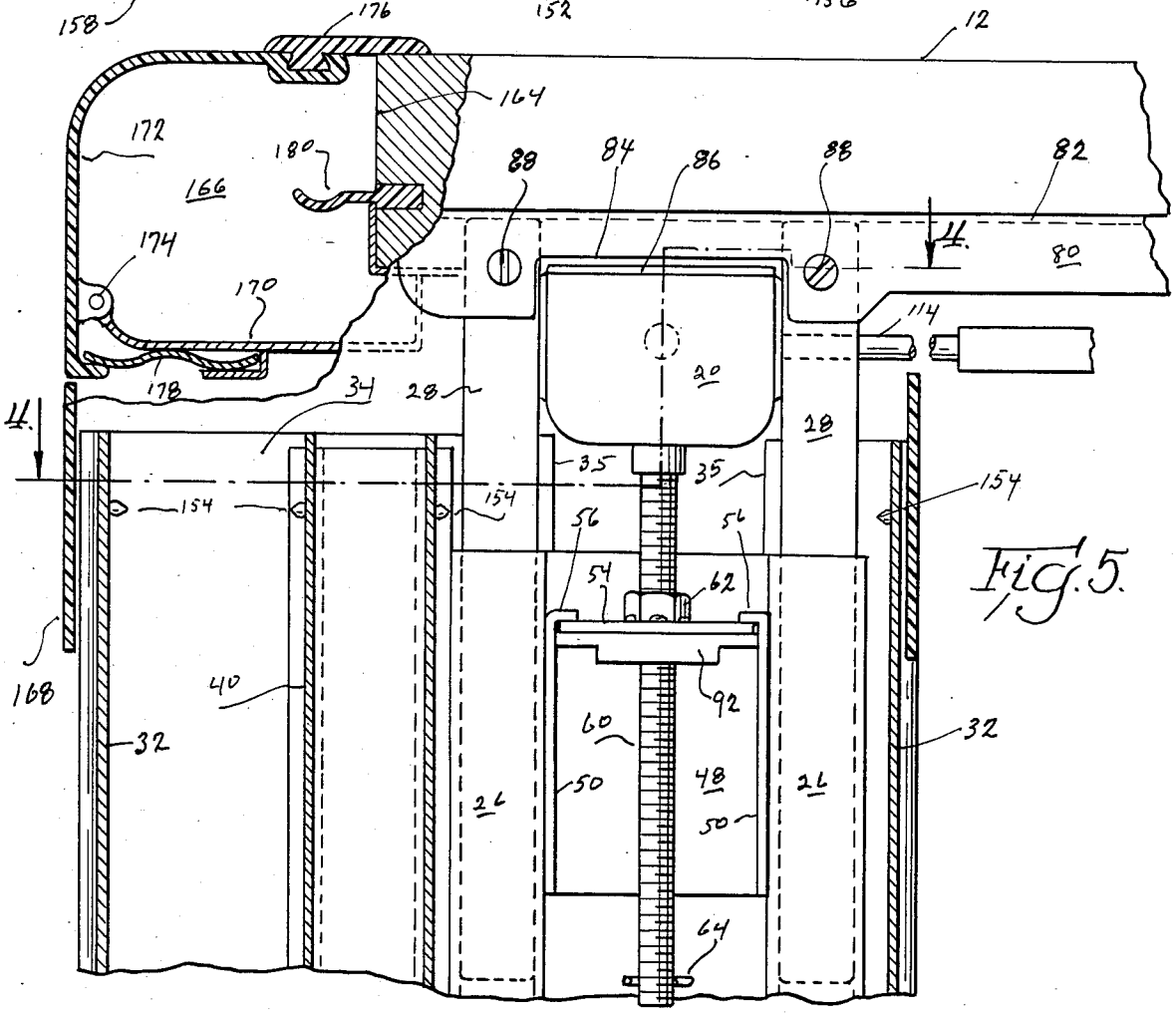
FIG. 5 is a partial section in side elevation.

Each guided member 28 has a hole 68 therein for receiving driveshaft 114 and other holes 72 so that they can be bolted to gearbox 20 by bolts 74 which are threaded into the bolt holes 76 therein to give the assembly shown in FIG. 5.

Fastened to the underside of the desk top is a channel member having sides 80 and a web 82. The sides 80 of the channel 78 are cut down at 84 to accommodate the gearbox housing 20 which, if desired, can be provided with a cover 86. The guide members 28 project into the channel 78 and are bolted therein by bolts 88 which extend through the sides 80 of the channel and through the bolt holes 90 in the guided members 28.

Figure 3:
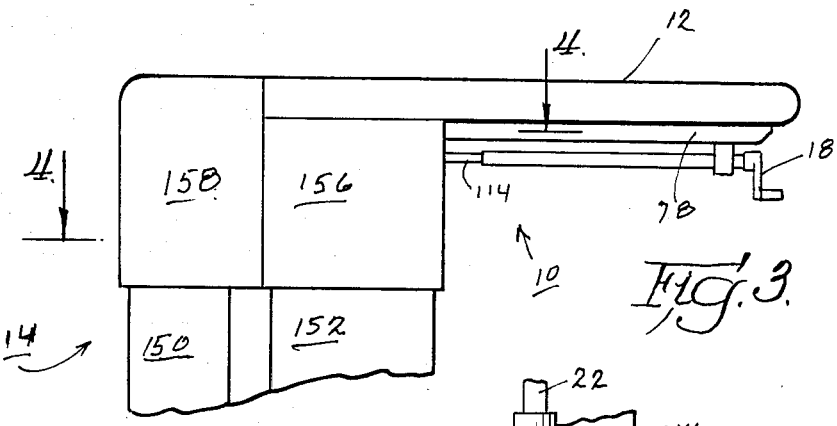
FIG. 3 is a partial side elevation.

The channel member 78 extends out under the top 12 as shown in FIG. 3 and rigidly supports the same in a horizontal position. The combination of the bolts 88 and the bolts 74 provide a rigid structure which cooperates with the legs 14 and the base member 16 to hold the desk top in the horizontal position.

If desired, the front edge 92 of the shelf 52 can be bent down to provide reinforcement.

Added rigidity to the structure can be provided by a longitudinal brace 93 extending from one leg to the other and fastened thereto by suitable lag screws or bolts (not shown) through bolt holes 94 (only one is shown) extending through the webs 48, 38 and 34.

The gearbox assembly comprises a gearbox housing 96 made of high-impact plastic, such as fiber-reinforced nylon or the like. It is generally rectangular in shape and has a bottom 98 which is normal to side walls 100 and front rear walls 102 and 104 respectively. The side walls 100 have axially-aligned, shaft-receiving bores 105. Centered around these bores and normal to the center line thereof are exterior flat faces 106 and interior smooth flat bearing faces 108. The exterior flat surfaces 106 form a base for the guided member 28 when it is bolted thereto, as described above, and the inner smooth flat surface acts as a bearing surface for the bearing sleeve or collar 110 of pinion gear 122 and the collar 112. These collars are affixed to the driveshaft 114 to prevent axial movement of pinion gear 122 and holds it in position to mesh with a master pinion gear 120 mounted to rotate on the bottom of the housing.

It is to be understood that the pinion gears are beveled so that rotation of one shaft can be transmitted to rotation of a shaft normal thereto. Also, that the various items described for one leg are duplicated for the other.

The master pinion gear 120 is splined to a driven shaft 124 which projects through a shaft-receiving bore 119 in bottom 98 and held thereon by split ring 123. The pinion gear 120 has a collar 118 which rotates on a smooth flat surface 116 on the bottom of the housing 96 normal to and centered around the center line of the bore 119 or on a shim 128 or raised portion, if needed, to cause the master pinion gear 120 to mesh with the auxiliary pinion gears 122 and 134.

The shaft 124 has a coupling 125 for coupling it with the elevator screw 60 and a thrust bearing 126, suitably, with ball bearings, to keep the thrust engendered by the elevator screw 60 from being transferred to the pinion gears.

The rear wall 104 has a bore 130 to receive shaft 132 which is normal to the driveshaft 114. It has a second auxiliary pinion gear 134 thereon in position to mesh with the master pinion gear 120. The bore 130 passes through an enlarged portion or hump 140 which extends into the housing far enough that the bore will have a length at least two times that of its bore. The hump 140 is spaced from the side walls 100 so that the dimension from the sides of the hump to the bore is substantially the same as the width of the walls of the housing 96.

The side walls 100 and the front and rear walls 102 and 104 respectively, have their upper surfaces in a common plane, except that the rear wall is cut down over the hump 140, as shown at 144, to the top of the hump 140. In this manner, the top 141 of the hump will have a thickness from the top to the bore substantially the same as the thickness of the walls of the housing. The bottom 98 is indented at 142 to reduce the amount of plastic surrounding the bore 130 so that the bottom wall of the bore also has a thickness measured down from the bore essentially the same as the thickness of the walls of the housing.

As best seen in FIG. 5, the web 34 is cut away, as shown at 35, to accommodate the gearbox assembly 20 as it is raised and lowered.

The pinion 134 is mounted on shaft 132, which in turn, has a coupling 146 affixed to the end, so that the unit 20 can be coupled through shaft 22 to a like unit 24 on the other leg. In that case, the driveshaft 114*a* is not utilized unless the user wants to switch the crank 18 to the other side.

The coupling 146 is separated from the wall 104 by spring washer 148 to keep the bearing ring or collar 136 seated on the bearing surface 130 and the gear 134 meshed with gear 120.

Figure 4:
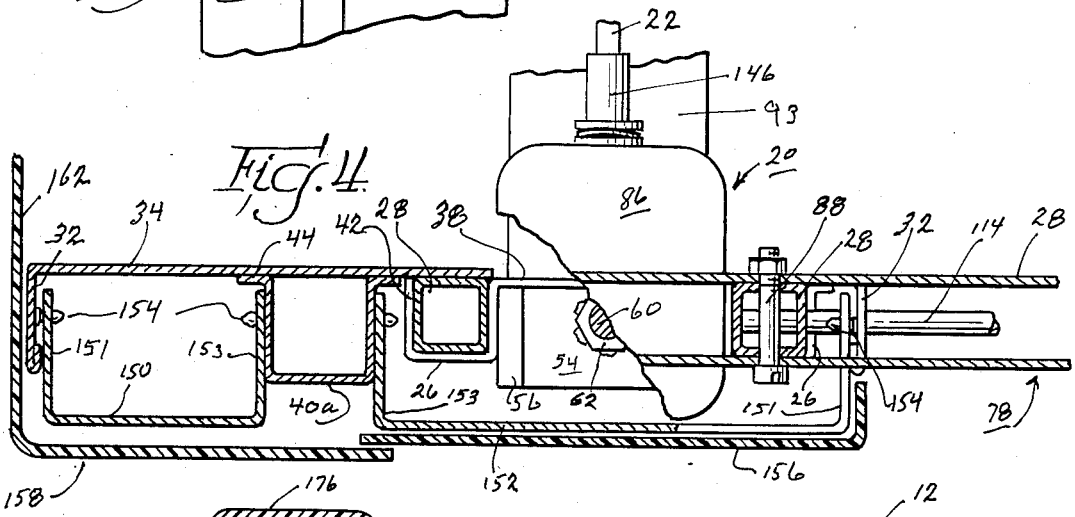
FIG. 4 is a section taken along line 4—4 of FIGS. 3 and 5.

Covers 150 and 152 of the legs are fastened in place, as shown in FIG. 4, by bayonet and pin connections 154 and thus can be easily removed for servicing. The sides 151 of the covers 150 can, if desired, be offset to line up with the sides 32. The opposite sides 153 can be offset in a like manner, if desired. The upper part of each leg is covered by skirts 156 and 158. The skirts 156 are fastened to the underside of the table top 12 by keyhole slots and screws (not shown) and skirt 158 has a flange (not shown) which abuts the rear ends of the top 12 and is fastened thereto by suitable means (not shown). The skirt 158 has a flat portion 160 on each side of the table top 12 which extends partly across the rear of the desk. The desk top 12 has a portion 164 which ends between the flat portions 160 of the skirt 158 so that a channel 166 is bounded by the rear portion 164 of the desk top and by the skirts 158. Also, there is provided, if desired, a rear panel 168 which extends along the rear from one skirt 158 to the other. The channel 166 has a bottom member 170, thereby making a closed conduit for holding electrical fixtures so that desk lamps, calculators, and so on, can be readily hooked up. The conduit or channel 166 has a cover 172 which is hinged at 174 and has a plastic lip 176 adapted to rest on the top of the desk, as shown in FIG. 5. A spring 178 is provided which will allow the cover to open and then again to snap into closed position.

It will be observed that the covers 150 and 152 do not extend all the way across the legs, but that they could, if it were so desired. As shown, the front face 40*a* of the post 40 is part of the cosmetic effect and is shown in FIG. 1.

Fastened to the rear 164 of the desk top is a gutter to prevent any spillage from contacting the electrical wiring in conduit 166.

It is to be understood that the invention is not to be limited to the exact details of construction, operation, or exact materials or embodiments shown and described, as various modifications and equivalents will be apparent to one skilled in the art, and the invention is therefore to be limited only by the full scope of the appended claims.

I claim:

1. In a vertically-adjustable desk having a flat top supported by a leg member having a fixed base portion and an adjustable top portion and means for adjusting said leg member to raise and lower said flat top comprising a driveshaft, a driven shaft, means for turning said driveshaft, an elevator screw threaded into a female screw affixed to said base portion of said leg member, and means for connecting said elevator screw to said driven shaft, whereby rotation of said driveshaft one way raises said top and rotation thereof in the other direction lowers it; the improvement in which the means for affixing said female screw member to the fixed portion of said leg member comprises a flat supporting plate unitarily comprising said female threaded member with the axis thereof normal thereto and horizontally-disposed, plate-supporting means affixed to the fixed base portion of said leg member, said supporting means having a transverse opening therein through which said flat supporting plate can be slid horizontally into said plate-supporting means.

2. A desk of claim 1, in which said plate-supporting means comprises a horizontally-disposed shelf member affixed to vertically-parallel post members of the fixed portion of said leg member and on which shelf member said supporting plate is supported and which comprises detents on said post members for removably holding said supporting plate on said shelf member.

3. A desk of claim 2, in which said plate-supporting means comprises a channel member, the sides of which are rigidly affixed to said post members.

4. A desk of claim 3, in which a portion of the web of said channel member is bent down to a position normal to the web and sides of said channel member to form said shelf member for supporting said flat supporting plate.

5. A desk of claim 4, in which portions of the sides of said channel member above said shelf member are bent in to a provide said detents, which portions are relatively short and parallel to said shelf member.

6. A desk of claim 1, in which the adjustable top portion of said leg member comprises vertically-parallel guided members depending from the desk top and the means for adjusting said leg member comprises a box-shaped housing of hard castable plastic having front, rear, and bottom walls and opposed side walls, which side walls are rigidly affixed to the inner sides of said vertically-parallel guided members; and said drive and driven shafts are journaled, respectively, in the side walls and bottom wall of said box-shaped housing.

7. A desk of claim 6, in which a second driven shaft is journaled in the rear wall of said housing, which wall is thick enough to provide a journal for said second driven shaft, which journal is at least two times as long as as the diameter of said second driven shaft.

8. In a vertically-adjustable desk having a flat top supported by a leg member having a fixed base portion comprising vertically-parallel, hollow post members and an adjustable top portion comprising vertically-parallel guided members vertically guided in said hollow post members and means for adjusting said leg member to raise and lower said flat top, comprising a driveshaft, a driven shaft, means for turning said driveshaft, an elevator screw threaded into a female screw affixed to said base portion of said leg member, and means for connecting said elevator screw to said driven shaft, whereby rotation of said driveshaft one way raises said top and rotation thereof in the other direction lowers it; the improvement in which the means for adjusting said leg member comprises a box-shaped gear housing of hard, castable plastic having front, rear, and bottom walls and opposed side walls, which side walls are rigidly affixed to the inner sides of said vertically-parallel guided members with the bottom wall normal thereto and in which said drive and driven shafts are journaled, respectively, in the side walls and bottom wall of said box-shaped housing.

9. A desk of claim 8, in which a second driven shaft is journaled in the rear wall of said housing, which wall is thick enough to provide a journal for said second driven shaft, which journal is at least two times as long as as the diameter of said second driven shaft.

10. A desk of claim 8, in which said plate-supporting means comprises a horizontally-disposed shelf member affixed to said vertically-parallel post members of the fixed portion of said leg member and on which shelf member said supporting plate is supported and which comprises detents on said post members for removably holding said supporting plate on said shelf member; in which said plate-supporting means comprises a channel member, the sides of which are rigidly affixed to said post members; in which a portion of the web of said channel member is bent down to a position normal to the web and sides of said channel member to form said shelf member for supporting said flat supporting plate; and in which portions of the sides of said channel member above said shelf member are bent in to a provide said detents, which bent-in portions are relatively short and parallel to said shelf.

11. A desk of claim 10, in which a second driven shaft is journaled in the rear wall of said housing, which wall is thick enough to provide a journal for said second driven shaft, which journal is at least two times as long as as the diameter of said second driven shaft.

12. A desk of claim 6, in which said guided members are anchored in a transverse channel member affixed to the underside of said flat top and said box-shaped housing and said transverse channel cooperate to maintain the top portion of said leg member and the unitary structure in which said guided members are maintained in the stated vertically-parallel position.

13. A vertically-adjustable desk structure having adustable leg members with telescoping side cover members comprising upper members affixed to the rear side edges of the top of said desk, said upper members extending beyond the rear edge of the top of said desk thereby providing a transverse channel along the rear edge thereof, and a hinged cover member spanning said channel having a flexible member on the forward edge thereof adapted to seat on the rear edge of said desk top and being spring-biased to closed position.

* * * * *

UNITED STATES PATENT AND TRADEMARK OFFICE

CERTIFICATE OF CORRECTION

PATENT NO. : 4,627,364

DATED : December 9, 1986

INVENTOR(S) : Thomas A. Klein and Peter M. Baker

It is certified that error appears in the above-identified patent and that said Letters Patent is hereby corrected as shown below:

Col. 3, line 67; "(now shown)" should read --(not shown)--

Signed and Sealed this

Twenty-first Day of April, 1987

*Attest:*

DONALD J. QUIGG

*Attesting Officer*

*Commissioner of Patents and Trademarks*